US009112287B2

(12) United States Patent
Toyama et al.

(10) Patent No.: US 9,112,287 B2
(45) Date of Patent: Aug. 18, 2015

(54) SWAGING CONNECTION STRUCTURE

(75) Inventors: Eiichi Toyama, Kosai (JP); Shigemi Hashizawa, Kosai (JP)

(73) Assignee: Yazaki Corporation, Tokyo (JP)

( * ) Notice: Subject to any disclaimer, the term of this patent is extended or adjusted under 35 U.S.C. 154(b) by 244 days.

(21) Appl. No.: 13/577,386

(22) PCT Filed: Feb. 2, 2011

(86) PCT No.: PCT/JP2011/052129
§ 371 (c)(1),
(2), (4) Date: Aug. 6, 2012

(87) PCT Pub. No.: WO2011/096425
PCT Pub. Date: Aug. 11, 2011

(65) Prior Publication Data

US 2012/0312597 A1 Dec. 13, 2012

(30) Foreign Application Priority Data

Feb. 5, 2010 (JP) ..... 2010-023722

(51) Int. Cl.

| | |
|---|---|
| ***H01R 4/18*** | (2006.01) |
| ***H01R 4/20*** | (2006.01) |
| *H01R 9/03* | (2006.01) |
| *H01R 13/6593* | (2011.01) |

(52) U.S. Cl.
CPC ..... *H01R 4/182* (2013.01); *H01R 4/20* (2013.01); *H01R 4/206* (2013.01); *H01R 9/032* (2013.01); *H01R 13/6593* (2013.01); *H01R 2201/26* (2013.01)

(58) Field of Classification Search
CPC ..... H01R 4/206; H01R 13/6593; H01R 2201/26; H01R 9/032; H01R 4/182; H01R 4/20
See application file for complete search history.

(56) References Cited

U.S. PATENT DOCUMENTS 3,331,917 A * 7/1967 O'Keefe et al. ..... 174/75 C
3,546,365 A * 12/1970 Collier ..... 174/78

(Continued)

FOREIGN PATENT DOCUMENTS

CN 101507051 A 8/2009
JP 2-25191 2/1990

(Continued)

OTHER PUBLICATIONS

Supplementary European Search Report dated Nov. 25, 2013, issued for the European patent application No. 11739773.7.

(Continued)

*Primary Examiner* — William H Mayo, III
*Assistant Examiner* — Krystal Robinson
(74) *Attorney, Agent, or Firm* — Locke Lord LLP

(57) ABSTRACT

A swaging structure is provided with a tubular metal foil member made of metal foil. The swaging connection structure is the one that a ring-shaped swaging member is swaged so as to include an area of main contact with a plurality of points or plurality of lines and an area of main contact with area, and thereby to electrically and mechanically contact the tubular metal foil member and a tubular connection part. The swaging connection member is also made a connection structure arranged such that an edge of a circumferential edge part of the ring-shaped swaging member is arranged not to contact with the tubular metal foil member.

20 Claims, 6 Drawing Sheets

(56) References Cited

U.S. PATENT DOCUMENTS

| | | | | |
|---|---|---|---|---|
| 3,828,298 | A * | 8/1974 | Schumacher | 439/442 |
| 4,025,145 | A | 5/1977 | Shaffer et al. | |
| 4,830,629 | A | 5/1989 | Yoshimura | |
| 5,051,543 | A * | 9/1991 | McGuire | 174/78 |
| 7,666,032 | B2 | 2/2010 | Aoki et al. | |
| 7,749,025 | B2 | 7/2010 | Aoki et al. | |
| 2009/0098779 | A1 * | 4/2009 | Kawamura | 439/733.1 |

FOREIGN PATENT DOCUMENTS

| | | | |
|---|---|---|---|
| JP | 8-236223 | A | 9/1996 |
| JP | 2005-327690 | A | 11/2005 |
| JP | 2008-66149 | | 3/2008 |
| JP | 2009-087902 | | 4/2009 |
| WO | WO-2010/024633 | A2 | 3/2010 |

OTHER PUBLICATIONS

Chinese Office Action dated May 28, 2014 for corresponding Chinese Patent Application No. 201180013523.4

International Search Report for PCT/JP2011/052129 dated Mar. 15, 2011.

* cited by examiner

SWAGING CONNECTION STRUCTURE

TECHNICAL FIELD

This invention relates to a swaging connection structure for mechanically and electrically connecting a ring-shaped metal foil member with a tubular metal foil member by swaging the ring-shaped swaging member.

BACKGROUND ART

The below PTL discloses a technology that by swaging a ring-shaped shield ring, an end of the tubular braided member disposed outside an electric wire and a tubular shield shell are mechanically and electrically connected to each other. In the aforementioned structure, the tubular braided member is made in such a way as to braid conductive fine element wires into tubular shape. The conductive shield shell is also formed operable to connect an end of the tubular braided member with its circumference. The shield ring, while inserting the tubular braided member therein, is swaged by a swaging mold so that the tubular braided member is configured to electrically connect with the shield shell. It is intended that, besides above, swaging the shield shell allows to avoid the tubular braided member, if drawn out, dropping out of the shield shell.

CITATION LIST

Patent Literature

[PTL 1]
Japanese Patent Application Laid-Open Publication No. 2009-87902

SUMMARY OF INVENTION

Technical Problem

The tubular braided member in the conventional art is made using, for example, as many as 300 lines, and thereby becomes relatively large and heavy. Request for downsizing and weight saving becomes high for components of a recent automobile, and thereby inventor to the present invention is of the opinion that in order to direct downsizing or weight saving, a tubular metal foil member made from conductive metal foil may be substituted for the tubular braded member.

However, the tubular metal foil member made from metal foil poses drawbacks that the tubular metal foil member, when swaged in the same condition as the tubular braided member, becomes easier to be broken than the tubular braided member. The tubular metal foil member also poses drawback that the tubular metal foil member, when tension is placed thereon, becomes easier to be broken than the tubular braided member. Thus, it poses possible drawback that reliability for electrical connection would be reduced or strength would become poor.

It should be noted that contact of the shield ring to such edges may cause the break of the tubular metal foil member. Such edges are induced when forming (that is, manufacturing) the shield ring. Specifically, ring circumference will induce edges thereof when punched by press.

Therefore, an object of the present invention is, in view of the above, to provide a swaging connection structure operable to secure connection reliability or strength even if including the tubular metal foil member made from metal foil.

Solution to Problem

In order to attain the above-mentioned object, according to a first aspect of the invention, a swaging connection structure includes: a tubular metal foil member made by forming conductive metal foil into tubular shape; a tubular connection part made of conductive metal and configured to be inserted inside the tubular metal foil member; and a metallic ring-shaped swaging member deformable by swaging, and configured to pass the tubular metal foil member therethrough, the ring-shaped swaging member including a first deformed part, and a second deformed part, both formed inwardly into edgeless shape by swaging the ring-shaped swaging member from its outside to inside, wherein the tubular metal foil member and the tubular connection part are made to abut to each other by the first deformed part and by the second deformed part so as to be mechanically and electrically connected with each other.

According to the present invention involving such feature, the ring-shaped swaging member may be made to be swaged in two steps by swaging tool in order to electrically and mechanically connect the tubular metal foil member and the tubular connection part, without their being broken. The ring-shaped swaging member may be deformed so as to induce no edge. The present invention makes it possible to include a part to be strongly swaged and a part to be weakly swaged by being deformed in two steps. According to the present invention, the connection structure may be made just neither to strongly swage nor to weakly swage the ring-shaped swaging member.

The swaging connection structure according to the invention of a second aspect wherein in the swaging connection structure of the first aspect, the first deformed part of the ring-shaped swaging member is configured by an edgeless deformed part contacting at area the tubular metal foil member and the tubular connection part, and wherein the second deformed part of the ring-shaped swaging member is a plurality of edgeless deformed parts contacting the tubular metal foil member and the tubular connection part in one way selected from at point, at line, and at area narrower than the first deformed part.

According to the present invention involving such feature, using the first deformed part as a part for weakly swaging, the tubular metal foil member and the tubular connection member are made contacted at area. This makes swaging of larger area operable. Whereas, using the second deformed part as a part for strongly swaging, the tubular metal foil member and the tubular connection member are made plurally contacted at area, or contacted at line, or contacted at area narrower than the first deformed part. This makes swaging of local area operable.

The swaging connection structure according to the invention of a third aspect wherein in the swaging connection structure of the second aspect, the second deformed part is configured by a plurality of edgeless deformed parts of lines arranged parallel to an axis of the ring-shaped swaging member, and in a radial direction of the ring-shaped swaging member.

According to the present invention involving such feature, tension in an axial direction of the tubular metal foil member is placed on the tubular metal foil member, and a break, if occurring at the second deformed part, is made minimized.

The swaging connection structure according to the invention of a forth aspect in the swaging connection structure of the second aspect, the second deformed part is a plurality of edgeless deformed parts arranged at intervals in a radial direction of the ring-shaped swaging member.

According to the present invention involving such feature, arrangement and the number of the second deformed part as a part for strongly swaging, and enlargement of area for the first deformed part as a part for weakly swaging according to the arrangement and the number makes electrical or mechanical connection stable.

The swaging connection structure according to the invention of a fifth aspect in the swaging connection structure of any one of the first to forth aspects, the first deformed part is located where more tension is placed in the tubular metal foil member than the second deformed part.

According to the present invention involving such feature, tension in the axial direction of the tubular metal foil member is placed in the tubular metal foil member has the tubular metal foil member pressed at the first deformed part, leading tension to terminate short of the second deformed part.

The swaging connection structure according to the invention of a sixth aspect in the swaging connection structure of any one of the first to fifth aspects, the tubular metal foil member is made of a metal foil or multi-layer including the metal foil.

According to the present invention involving such feature, it is made possible to adjust strength of the tubular metal foil member. E.g., twofold metal foil, when strengthening the tubular metal foil member made of metal foil, makes stronger than one fold thereof. Note that as one exemplified method for making twofold metal foil, there is a method for folding into twofold only the part for swaging. Besides this method, according to the present invention, it is made possible to strengthen the tubular metal foil member by including one layer metal foil in its multi-layer. In this case, it is preferable to stack resin sheets in the form of laminae onto the metal foil to adhere.

Advantageous Effects of Invention

According to the invention of the first aspect, it involves effect to secure connection reliability and strength even if including tubular metal foil formed by metal foil. Since the present invention allows for securing connection reliability and strength, it also has effect for allowing for usage of conventional equipment.

According to the invention of the second aspect, it involves effect of providing a preferable example for securing connection reliability and strength.

According to the invention of the third aspect, it involves effect to minimize the break if occurring at the second deformed part. Thus, it has effect to contribute prevention of connection reliability reduction and lack of strength.

According to the invention of the forth aspect, it involves effect to further steady electrical and mechanical connection.

According to the invention of the fifth aspect, it involves effect not to work tension to the second deformed part. Thus, it is made possible to securely prevent the break at the second deformed part, and therefore it involves effect to contribute prevention of connection reliability reduction and lack of strength.

According to the invention of the sixth aspect, it involves effect to allow provision of one embodiment operable to improve its mechanical strength of the tubular metal foil member.

DESCRIPTION OF EMBODIMENTS

A swaging connection structure relevant to the present invention is one that a ring-shaped swaging member is swaged using a strongly swaging area that contacts mainly with a plurality of points, a plurality of lines, or a plurality of small areas, and a weakly swaging area that contacts mainly with a large area, and that a tubular metal foil member and a tubular connection part are thus electrically and mechanically connected to each other.

The swaging connection structure of the present invention is one that circumferential edge of the ring-shaped swaging member is arranged not to contact with the tubular metal foil member.

A First Embodiment

Figure 1:
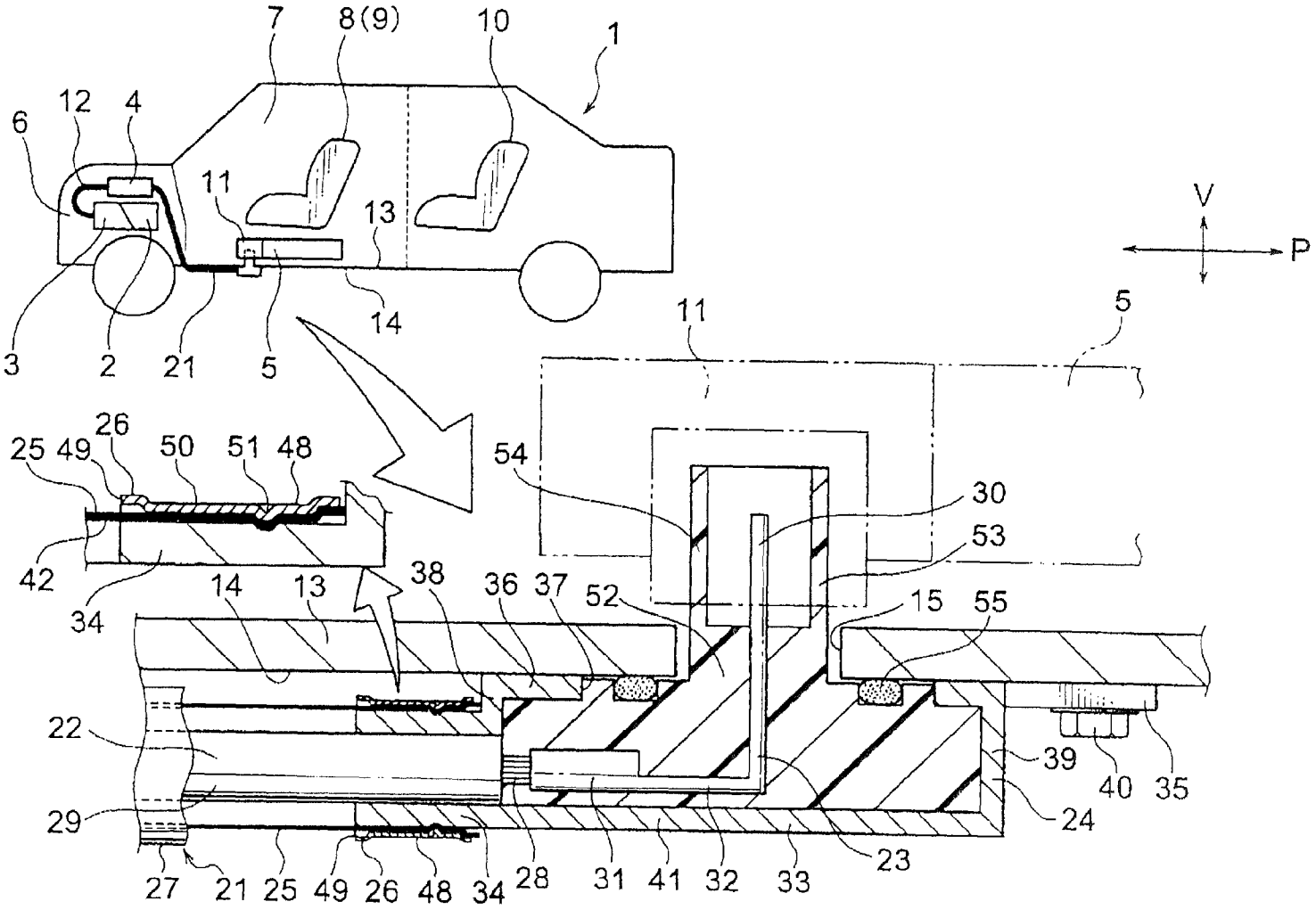
FIG. 1 is a frame view of a vehicle including a swaging connection structure according to the present invention and a cross-sectional view enlarging its main part.
Figure 2:
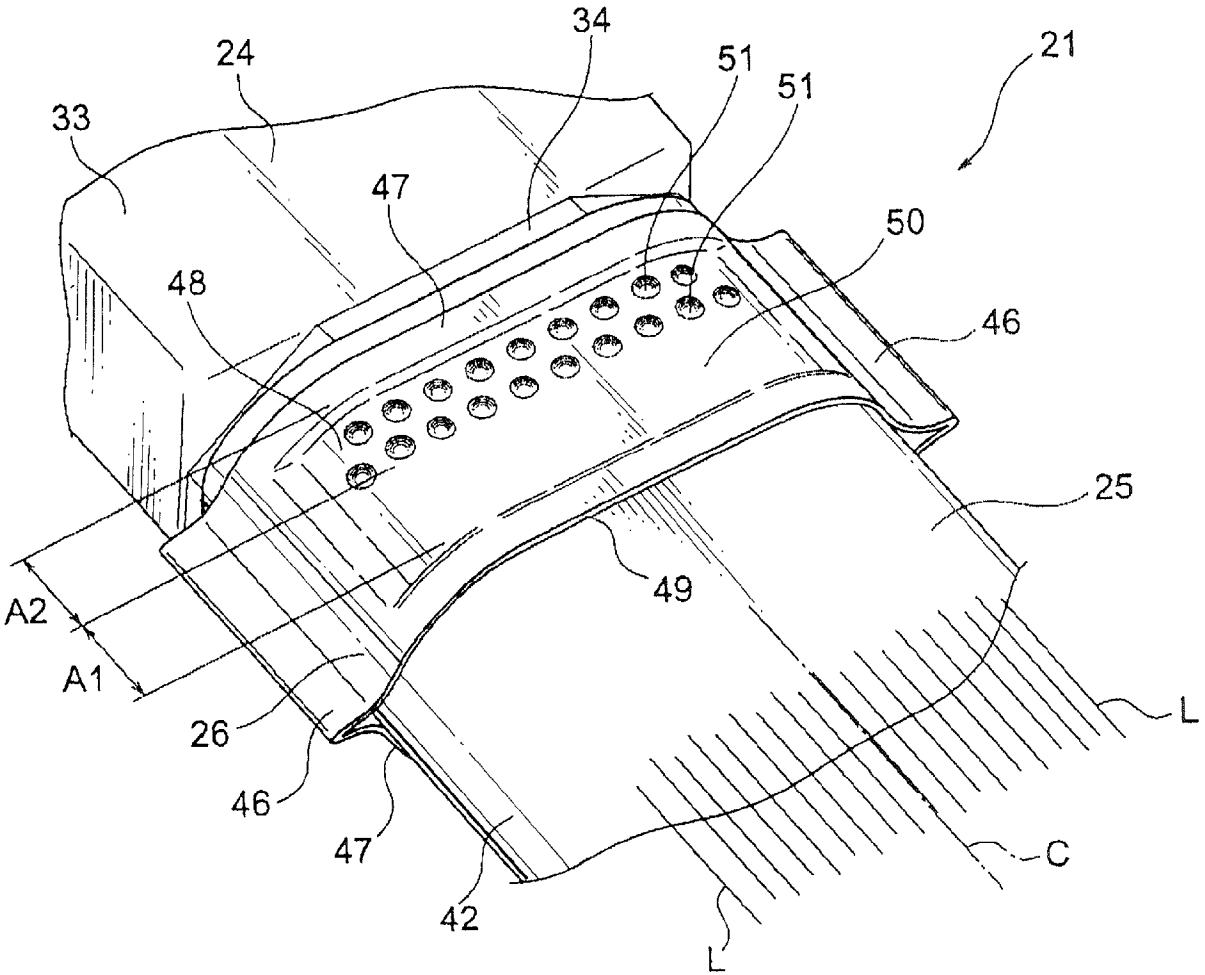
FIG. 2 is a perspective view illustrating an end part of a wire harness including the swaging connection structure in FIG. 1.

Hereinafter, referring to the drawings, the first embodiment will be discussed. FIG. 1 is a frame view of a vehicle including a swaging connection structure according to the present invention and a cross-sectional view enlarging its main part. FIG. 2 is also a perspective view illustrating an end part of a wire harness including the swaging connection structure in FIG. 1, FIG. 3 a cross-sectional view illustrating a structure of a tubular metal foil member.

A wire harness of the present embodiment as discussed later is directed to what is wired in a hybrid vehicle or an electric vehicle. Hereinafter the hybrid vehicle will be exemplified (with the electric vehicle, an arrangement, a structure and an effect of the wire harness in the present invention are also made the same. It should be noted that not only the hybrid vehicle and the electric vehicle but a conventional vehicle are applied to the present invention).

Referring to FIG. 1, the reference sign 1 directs the hybrid vehicle. The hybrid vehicle 1 is the one that is driven by combination of two powers, a engine 2 and the motor 3, to which the motor 3 electric power is designed to apply from a battery 5 (a battery pack) via an inverter 4. The engine 2, the motor 3, and the inverter 4 are installed in an engine room where front wheels are located. The battery 5 is also installed in a vehicle room 7 located at rearward of the engine room 6. In the vehicle room 7 a driver seat 8, a front passenger seat 9, and a rear passenger seat 10 are provided.

The battery 5 is disposed between the driver seat 8 and the front passenger seat 9 (an arrangement thereof will be one example). In the present invention, in the front of the battery 5 a junction block 11 that is adapted to be connected to the battery 5 is disposed.

The motor 3 and the inverter 4 are connected to each other through a motor cable 12. The battery 5 and the inverter 4 are also connected by a wire harness 21. The wire harness 21 are wired form the engine room 6 to an under floor 14 positioned at a land side of the floor panel 13.

The wire harness 21 is made unnecessary to be wired across the floor panel 13 into the car room 7. Specifically, a through hole 15 is formed at a predetermined position in the floor panel 13, though which after-mentioned high voltage electric wire 22 in the wire harness 21 is made unnecessary to pass. The through hole 15 is disposed in conformity with a position of the junction block 11.

Herein the present embodiment being complemented, the motor 3 is made to include a motor and a generator. The inverter 4 is also made to include an inverter and a converter. The inverter 4 is an inverter assembly, in which, for example, an air conditioner inverter, generator inverter, or a motor inverter may be included. The battery 5 is made of Ni-MH, or Li-ion, being assembled into a type of module. It should be noted that a storage device such as a capacitor may be employed. The battery 5 is not limited to the hybrid vehicle or the electric vehicle if usable.

The wire harness 21 as described above is wired across the engine room 6 and the under floor 14, involving a feature applying a swaging connection structure relevant to the present invention. The wire harness 21 is provided with a plurality of high voltage electric wires 22 (or a high voltage electric wire), a connection part 23 disposed at one end of the high voltage electric wire 22 and electrically connected with the junction block 11 (a mating connection), a terminal fixing member 24 made of conductive metal material, a tubular metal foil member 25 arranged to cover the plurality of high voltage electric wire 22, a ring-shaped swaging member 26 disposed outside a terminal of the tubular metal foil member 25 and being made swaged, a electric wire protector 27 entirely passing outside, and protecting, a protection part in the plurality of the high voltage electric wire 22 covered by the tubular metal foil member 25.

The aforementioned plurality of high voltage electric wires 22 is provided with the number of two (the number is one example; low voltage electric wire may be included), and is wired alongside in a longitudinal direction on FIG. 1 (that is, wired so as to lie along the under floor 14). The high voltage electric wire 22 is thick, a conductive body of which is made from copper, copper alloy or aluminum. The high voltage electric wire 22 is non-shielded electric wire, and is composed of a core conductor 28, a cover 29 disposed outside the core conductor 28. The one terminal of the high voltage electric wire 22 is treated to straightly extend with a predetermined length and to expose.

The core conductor 28 may be any one of conductive structures, a braiding of element wires, or a bar-shaped in oblong or round cross-sectional shape (e.g., a plane core, or a round core). Such the core conductor 28 is connected with a connection member 23.

The aforementioned connection member 23 as mentioned above is an electrical connection with the junction block 11, a tip of which is formed into a terminal shape, nearly tub one. The connection member 23 is provided with a electric contact part 31 positioned at a tip side, an electric wire connection part 31 adapted to be connected with the core conductor 28 by swaging, and a middle part 32 connecting these electric contact part 30 and the electric wire connection part 31. The electric contact part 30 is bent so as to be normal to the middle part 32. The connection member 23 is entirely bent in nearly L-shape. The connection member 23 is electrically connected with the junction block 11 in a perpendicular direction shown by the arrow V in FIG. 1.

The aforementioned terminal fixing member 24 is the one for fixing the plurality of high voltage electric wires 22 and the connection member 23 while located at a predetermined position of the under floor 14, which as mentioned above in the present invention is made from conductive metal material. The terminal fixing member 24 is formed into such a shape as to position the terminal of the high voltage electric wire 22 near the through hole 15 of the floor panel 13, and the connection member 23 at the through hole 15. The terminal fixing member 24 in the present invention is provided with a housing part 33, and a tubular connection part 34 and a fixing flange 35 formed to communicate with the housing part 33.

The housing part 33 includes an opening 37 at an upper wall 36, and is formed such that the tubular connection part 34 is continuously formed at a side wall 38 so as to communicate with inside thereof. In a side wall 39 other than the side wall 38, the fixing flange 35 is continuously formed at the upper wall 36. The fixing flange 35 is formed to serve as a part for fixing with a bolt 40. The terminal fixing member 24 in the present invention is formed to be fixed to the under floor 14 with the bolt 40. It should be noted that not being specifically depicted, the fixing flange 35 is formed in at least two points. The upper wall 36 is formed as a part for contacting with the under floor 14. The upper wall 36 serves as a part for grounding a car body A bottom wall 41 of the housing part 33 is formed so as to be flat and parallel to the under floor 14. The tubular connection part 34, while the terminal fixing member 24 is fixed to the under floor 14, is also parallel to the under floor 14. The tubular connection member 34, as the under floor 14 extends in a horizontal direction shown by the arrow P, is formed to extend in the same direction.

The tubular connection part 34 is formed so as to let the tubular metal foil member 25 pass through its outside. The tubular connection part 34 is formed so as to electrically and mechanically connect the tubular metal foil member 25 by swaging of the ring-shaped swaging member 26. The tubular connection part 34 in the present invention is formed into an elliptical cross-sectional shape. The tubular connection part 34, as formed continuous to the housing part 33, is metallic as well as conductive. It should be noted that the tubular connection part 34 is formed as a known shield shell, and may be connected with the housing part 33 with any fixing means such as bolt fixing.

Figure 3A:
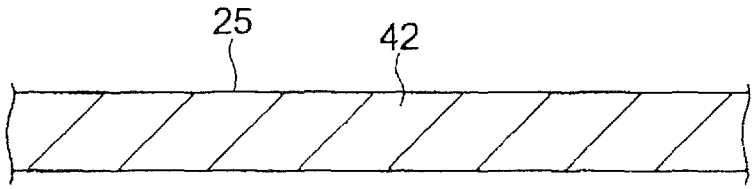
FIG. 3A is a cross-sectional view illustrating a structure of a tubular metal foil member.

The aforementioned tubular metal foil member 25 is made by forming conductive metal into a tubular shape, which serves as electromagnetic shield as an electromagnetic measure. As an example for composing the tubular metal foil member 25, such copper foil is preferred (known metal foil other than the copper foil may be, needless to say, preferred). The tubular metal foil member 25 in the present invention, as shown in FIG. 3A, is solely made from the metal foil 42, but may be twofold or threefold of the metal soil 42 for its strength.

Figure 3B:
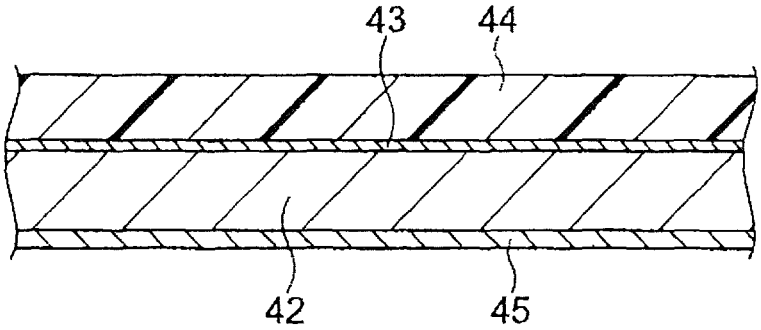
FIG. 3B is a cross-sectional view illustrating a structure of a tubular metal foil member.

It should be noted that, as shown in FIG. 3B, the tubular metal foil member 25 including the metal foil 42 as one of a plurality of layers improves the strength thereof. It is preferred in this case to stack in layers resin sheets 44 onto the metal foil 42 (copper foil), interposing an adhering layer 43. The PET sheet may be taken as an example of the resin sheet 44. The reference sign 45 shows tin coat that is in layers. Providing of the tin coat 45 may be optional.

The tubular metal foil member 25 is in the present invention formed into an oval cross-sectional shape. The tubular metal foil member 25 is formed such that a terminal thereof passes the tubular connection part 34 therethrough. The terminal of the metal foil member 25 is electrically and mechanically connected with the tubular connection part 34 by swaging the ring-shaped swaging member 26.

The aforementioned ring-shaped swaging member 26 is made of material which is permanently deformable by swaging (crushing) with not-shown swaging mold in such a direction that it s inner and outer diameters shrink, and is formed by pressing, e.g., a strip-shaped metal thin plate into an oval shape. The ring-shaped swaging member 26, as shown in FIGS. 1 and 2, is configured to be disposed outside the terminal of the tubular metal foil member 25. The ring-shaped swaging member 26, when swaged from outside to inside thereof, has both ends 46 crushed in a predetermined shape as well as an upper and a lower sides 47 crushed in a predetermined shape.

In the present invention, a swaging part 48 made by swaging of the upper and lower sides 47 of the ring-shaped swaging member 26 corresponds to the swaging part of the present invention. Hereinafter, there will be specific discussions.

The swaging part 48 made by swaging of the upper and lower sides 47 is formed by deforming in two steps the ring-shaped swaging member 26 inwardly, and by deforming so as not to induce any edge such as a circumferential edge part 49. Namely, the swaging part 48 is formed inwardly in two steps into edgeless part. The swaging part 48 includes a first deformed part 50 and a second deformed part 51.

The first deformed part 50 is a part that is formed at a central area of the ring-shape swaging member 26 except the circumferential edge part 49 in its axial direction and is formed by weakly swaging (that is, an area to be weakly swaged), so as to contact at line the tubular metal foil member 25 and the tubular connection part 34. The first deformed part 50 is made so as to crimp with broad area the tubular metal foil member 25 and the tubular connection part 34 and so as to secure mechanical strength such tensile strength. The first deformed part 50 is also made so as to secure a working area to press the metal foil 42 composing the tubular metal foil member 25 in such a degree as not to break (refer to A1 in FIG. 2 with regard to an area corresponding to the first deformed area 50). The first deformed part 50 is arranged separated from the circumferential edge part 49. The first deformed part 50 is also arranged at nearer a side where the electric wire is drawn than the second deformed part 51. That the first deformed part 50 is arranged nearer the side where the electric wire is drawn out is because the tubular metal foil member 25 is pressed by the first deformed part 50 and because tension does not work on the second deformed part 51.

The second deformed part 51 is a part that is disposed in the first deformed part 50 and is made strongly pressed (that is, an area to be strongly pressed), so as to plurally contact at point the tubular metal foil member 25 and the tubular connection part 34 in the present invention (which may be formed so as to contact with considerably smaller area than the first deformed part 50. The smaller area is formed so as to secure the after-mentioned electrical conduction but is not limited to its form. Refer to A2 in FIG. 2 with regard to an area corresponding to the first deformed area 50). The second deformed part 51 is made so as to strongly and locally press the tubular metal foil member 25 and the tubular connection part 34 to fix, and to strongly contact to mainly secure electrical conduction. The second deformed part 51 in the present invention is plurally formed in dimple. The deformed part 51 is arranged at a predetermined position. Specifically, if a plurality of lines L that is parallel to a central axis C of the ring-shaped swaging member 26 is disposed on the ring-shaped swaging member 26 in its radial direction, one second deformed part 51 is present every line L. Such arrangement has an advantage that tension works on the tubular metal foil member 25 so as to confine the break to a minimum extent even if the second deformed part 51 is broken (the tubular metal foil member 25 is pressed by the first deformed part 50 that is arranged nearer the side where the electric wire is drawn out so that the tension does not work on the second deformed part 51, whereas if it works on the second deformed part 51 the break is confined to a minimum extent by the aforementioned arrangement or form of the second deformed part 51, i.e., confined to not a large extent). The second deformed part 51 may be arranged not only in cross-stitch formation but in one line or plural line perpendicular to the central axis C. The second deformed part 51 is plurally arranged at intervals in the circumferential direction of the ring-shaped swaging member 26.

The first deformed part 50 and the second deformed part 51 are arranged such that a part that is formed into a step contacts the tubular metal foil member 25 with its rounded surface (edgeless surface). I.e., the break of the tubular metal foil member 25 by any edge is unlikely induced.

When the end part of the tubular metal foil member 25 is electrically and mechanically connected with the tubular connection part 34 by swaging of the ring-shaped swaging member 26, a plurality of high voltage electric wires 22 (the cover 29) accommodated in the tubular metal foil member 25 is arranged parallel to the under floor 14. Note that as the high voltage electric wire 22 a cab-tire cable may be employed, but not limited to. The tubular metal foil member 25 electrically connected with the tubular connection part 34 is made grounded to the floor panel 13.

The connection member 23 disposed in the terminal of the high voltage electric wire 22, when accommodated in the housing part 33, is made fixed by the housing 52 made of insulative resin material. There is disposed in the housing 52 a connector engaging part 53 protruding upwardly from the opening 37 of the upper surface 36, in an internal space of which the connector engaging part 53 the electric contact part 30 is exposed. By the housing being formed, the part serves as a connector 54.

Note that a method of making the housing 52 is not specifically limited. E.g., it may be one such that the connection part 23 is integrated with resin sub housing, following filing up a gap between the sub housing and an inside of the housing part 33 by resin such as potting.

In the housing 52 a packing 55 is disposed adjacent to the through hole 15 in the floor panel 13. The packing 55 closely contact the under floor 14 such as to surround the through hole 15 so as to serve as prevention of infiltration of water.

The aforementioned protection part 27 is a member that entirely passes therethrough, and protect, a protected part of the plurality of high voltage electric wires 22 covered by the tubular metal foil member 25, which is, in the present invention, formed from an elongated standard pipe composed of a standard pipe deformable and elongated (the elongated standard pipe is plurally arranged in the wire harness 21 when the protected part is plurally present. The protected part includes not only a main part but its branches).

The elongated standard pipe as one example of the electric wire protecting member 27 is synthetic-resin-made or metallic (with metal, taken as one example is stainless or aluminum). The protecting member 27, in a process following passing therethrough, and protecting, the plurality of high voltage electric wires 22 and the tubular metal foil member 25 (that is, in a post process), is formed deformable (but not limited to this, it is also possible to bend the pipe prior to passing through the plurality of high voltage electric wires 22 and the tubular metal foil member 25. Presence or absence of bending is based on its wiring route).

Such electric wire protecting member 27 is provided with a not-shown fixing part. The fixing part in the present invention is a clamp dedicated to pipe, including a part formed so as to wind on circumference of the electric wire protecting member 27, a screw holder (or a part operable to wire a wire harness 21 such as a lean-hose) operable to hold the under floor 14 of the floor panel 13 (it is also possible to form the fixing part not with the aforementioned pipe dedicated clamp but with such a band or a clip).

In the aforementioned configure or structure, wiring of the wire harness 21 in the under floor 14 is completed such that the connection part 23 is positioned at the through hole 15, and the plurality of high voltage electric wires 22 is guided along the under floor 14 and is arranged parallel to the under floor 14 while accommodated in the electric wire protecting member 27, and then the terminal fixing part 24 and the electric wire protecting member 27 are fixed to the under floor 14. After such wiring, the wire harness 21 is electrically connected near the through hole 15 to the junction block 11 by installing such the battery 5.

As discussed above with reference to FIGS. 1 to 3, applying the swaging structure of the present invention, i.e., swaging with the first deformed part 50 and the second deformed part 51 brings results of enough security of connection reliability or strength though the tubular metal foil member 25 made of metal foil is included in its structure.

A Second Embodiment

Figure 4:
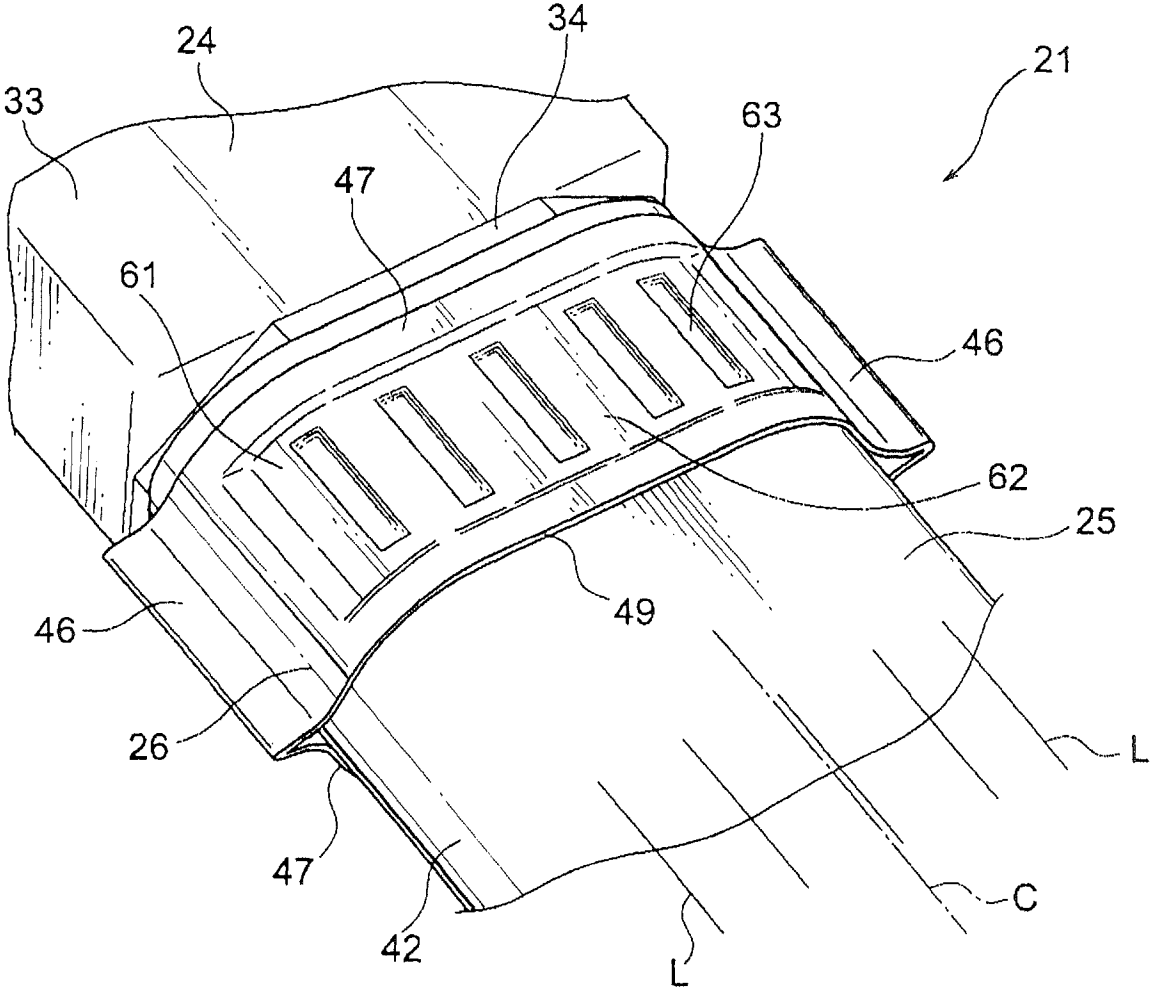
FIG. 4 is a perspective view illustrating an end part of a wire harness including a swaging connection structure according to other embodiment of the present invention.
Figure 5:
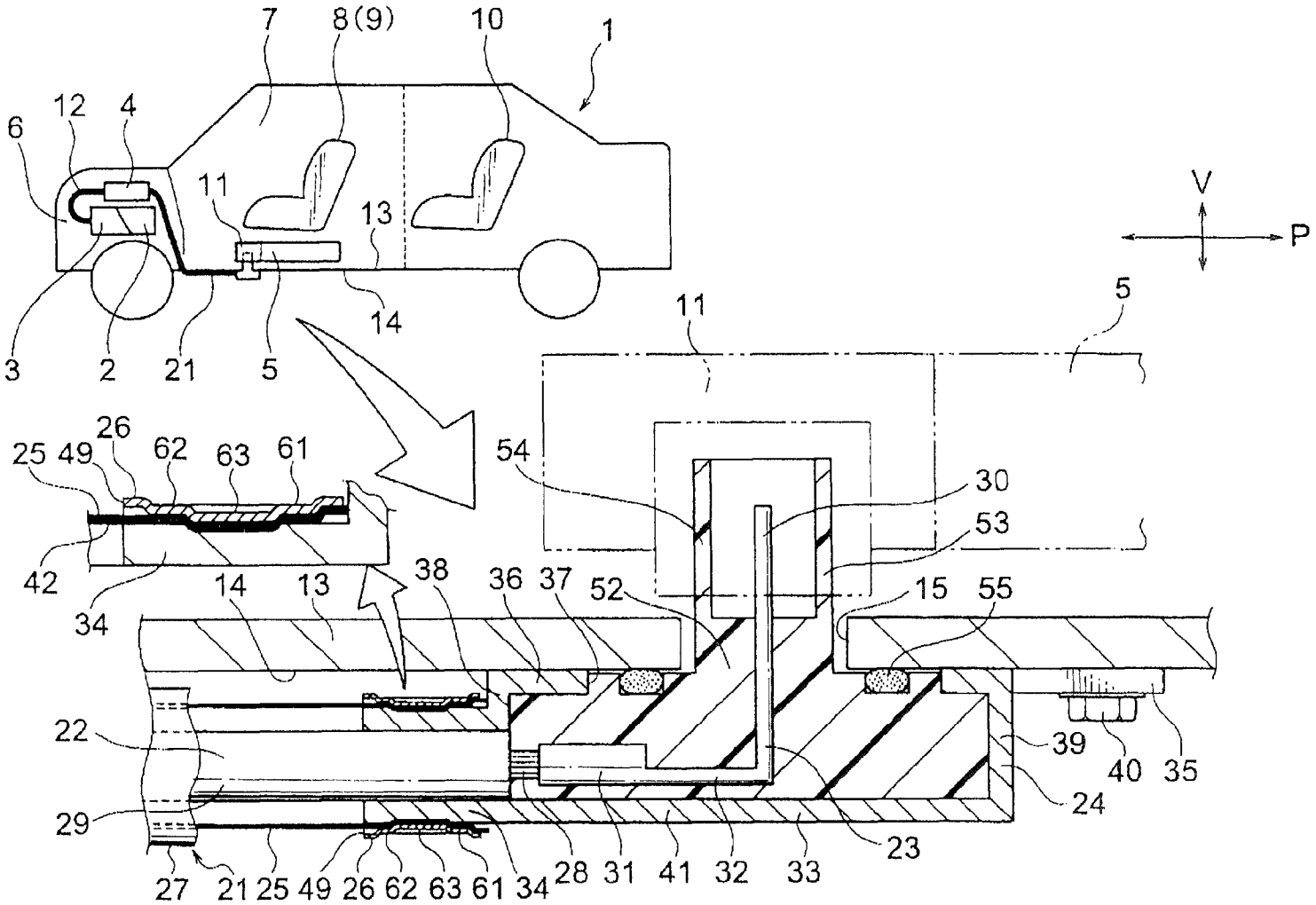
FIG. 5 is a frame view of the vehicle including the swaging connection structure in FIG. 4 and a cross-sectional view enlarging its main part.
Figure 6:
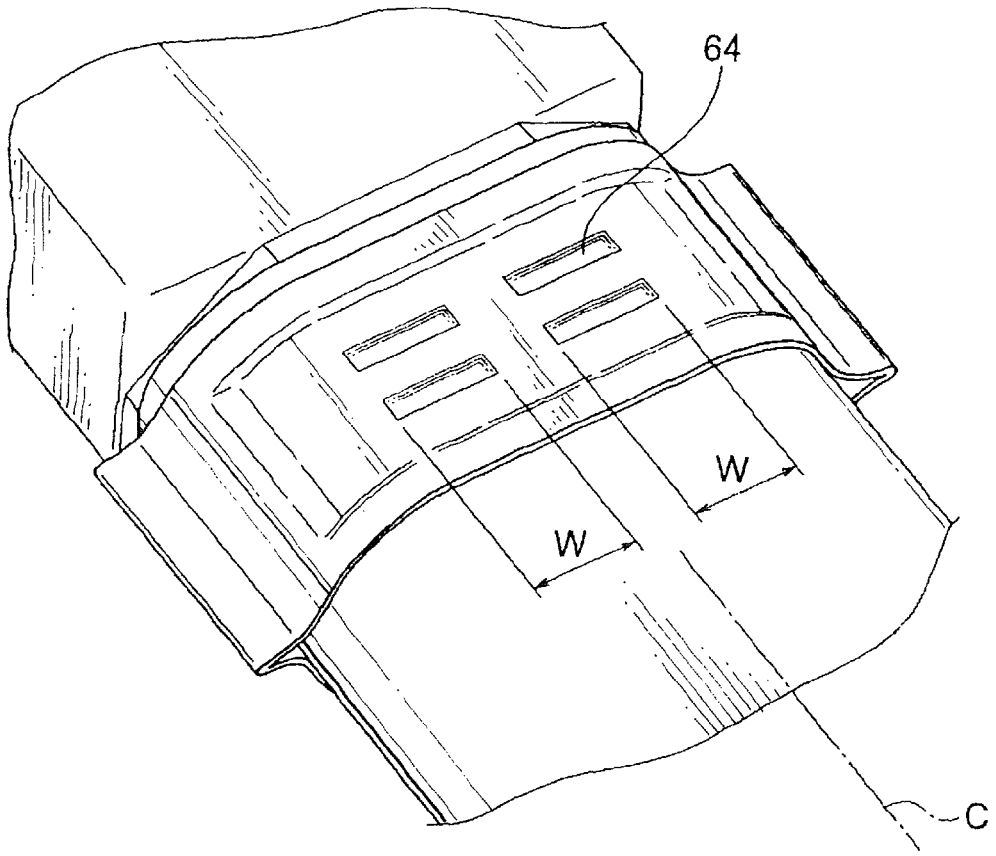
FIG. 6 is a perspective view of a swaging connection structure for comparison.

Hereinafter, the second embodiment will be discussed with reference to the drawing. FIG. 4 is the perspective view of the terminal part of the wire harness including swaging connection part that is other embodiment of the present invention. FIG. 5 is a frame view of the vehicle including the swaging connection structure in FIG. 4 and a cross-sectional view enlarging its main part. FIG. 6 is a perspective view of a swaging connection structure for comparison. Note that the same element part as the aforementioned embodiment 1 is marked with the same reference sign, not repeating herein detail description.

In FIGS. 4 and 5, the swaging part 61 made by crush of the upper and lower sides 47 is formed by deforming inwardly in two steps the ring-shaped swaging member 26. Furthermore, the swaging part 61 is deformed avoiding inducing of any edge such as a circumferential edge part 49. Namely, the swaging part 61 is formed inwardly in two steps into an edgeless deformed part. The swaging part 61 has a first step deformed part 62 and a second step deformed part 63.

The first step deformed part 62 is disposed at central area except circumferential edge part 49 in a axial direction of the ring-shaped swaging mamber 26 and is a part made by weakly swaging (an area weakly swaged), which is formed operable to contact at area the tubular metal foil member 25 and the tubular connection part 34. The first step deformed part 62 is made so as to crimp with large area the tubular metal foil member 25 and the tubular connection part 34, and so as to secure mechanical strength such tensile strength. The first step deformed part 62 is made so as to secure an area where metal foil composing the tubular metal foil member 25 is pressed in a degree not inducing a break. The first step deformed part 62 is arranged spaced from the circumferential edge part 49. The first step deformed part 62 is also arranged such that a part thereof is positioned nearer a side where electric wire is drawn out than the second step deformed part 63.

The second step deformed part 63 is a part disposed in the first step deformed part 62 and is made by strongly swaging (an area to be strongly swaged), which is formed operable to plurally contact at line the tubular metal foil member 25 and the tubular connection part 34 (which may be formed so as to contact with considerably smaller area than the first deformed part 50. The smaller area is formed so as to secure the aftermentioned electrical conduction but is not limited to its form). The second step deformed part 63 is made so as to strongly and locally press the tubular metal foil member 25 and the tubular connection part 34 to fix, and to strongly contact to mainly secure electrical conduction. The second step deformed part 63 in the present invention is plurally formed in bead formation. The second step deformed part 63 is arranged at a predetermined position. Specifically, if a plurality of lines L that is parallel to a central axis C of the ring-shaped swaging member 26 is disposed on the ring-shaped swaging member 26 in its radial direction, one second deformed part 51 is present every line L. Such arrangement has an advantage that tension works on the tubular metal foil member 25 so as to confine the break to a minimum extent even if the second step deformed part 63 is broken. The second deformed part 53 is plurally arranged at intervals in the circumferential direction of the ring-shaped swaging member 26.

Note that arrangement of the second step deformed part 63 in bead formation is not limited to the above. E.g., as shown in FIG. 6 a second step deformed part 63 in bead formation is plurally disposed in a direction perpendicular to central axis C. Not specifically shown, it is also possible to be plurally disposed inclined relative to the central axis C. A break in the second step deformed part 64, if induced, is made to large extent of W, but is made strengthened against tension.

As discussed above with reference to FIGS. 4 to 6, applying the swaging structure of the present invention, i.e., swaging with the first step deformed part 62 and the second step deformed part 63 brings results of enough security of connection reliability or strength though tubular metal foil member 25 made of metal foil is included in its structure.

It is to be understood the present invention is just shown by the aforementioned embodiment as a typical embodiment but is not limited to this embodiment. Therefore, unless otherwise such changes and modifications depart from the scope of the present invention hereinafter defined, they should be construed as being included therein.

Note that configuration and structure such as the aforementioned embodiments 1 and 2, though not related to the swaging connection structure of the present invention, makes itself a wire harness 21 unnecessary to wire the high voltage electric wire 22 into the car room across the floor panel 13. This allows workability, space saving, or cost reduction. The high voltage electric wire 22 being not across the floor panel 13 requires the high voltage electric wire 22 being bent at the through hole 15, and allows wiring to space the wire harness 21 as much as possible from the ground (spacing as much as possible from the ground allows lower height).

The high voltage electric wire 22 being not across the floor panel 13 makes insertion work through the through hole 15 unnecessary, and the wire harness 21 overall short. The wire harness 21 being wired in the under floor 14 also allows to electrically connect the connection member 23 arranged at the through hole 15 and the junction block 11 in the floor panel 13 near the car room, and the wire harness 21 to be good workability for connection.

REFERENCE SIGNS LIST

1 hybrid vehicle
2 engine
3 motor
4 inverter
5 battery
6 engine room
7 car room
8 driver seat
9 front passenger seat
10 rear passenger seat

11 junction block
12 motor cable
13 floor panel
14 under floor
15 through hole
21 wire harness
22 high voltage electric wire
23 connection member
24 terminal fixing part
25 tubular metal foil member
26 ring-shaped swaging member
27 electric protecting member
28 core conductor
29 cover part
30 electric contact part
31 electric wire connection part
32 middle part
33 housing part
34 tubular connection part
35 fixing flange
36 upper wall
37 opening
38, 39 side wall
40 bolt
41 bottom wall
42 metal foil
43 adhering layer
44 resin sheet
45 tin coat
46 both sides
47 upper and lower side
48 swaging part
49 circumferential edge part
50 first deformed part
51 second deformed part
52 housing
53 connector engaging part
54 connector
55 packing
61 swaging part
62 first step deformed part
63,64 a second step deformed part
C central axis
L line

The invention claimed is:

1. A swaging connection structure, comprising:

a tubular metal foil member made by forming conductive metal foil into tubular shape;

a tubular connection part made of conductive metal and configured to be inserted inside the tubular metal foil member; and a metallic ring-shaped swaging member deformable by swaging, and configured to pass the tubular metal foil member therethrough, the ring-shaped swaging member including a first deformed part, and a second deformed part, both formed inwardly into edgeless and dent shape by swaging the ring-shaped swaging member from its outside to inside, wherein the tubular metal foil member and the tubular connection part are made to abut to each other by the first deformed part and by the second deformed part so as to be mechanically and electrically connected with each other.

2. The swaging connection structure as claimed in claim 1, wherein the first deformed part of the ring-shaped swaging member is configured by an edgeless deformed part contacting at area the tubular metal foil member and the tubular connection part, and wherein the second deformed part of the ring-shaped swaging member is a plurality of edgeless deformed parts contacting the tubular metal foil member and the tubular connection part in one way selected from at point, at line, and at area narrower than the first deformed part.

3. The swaging connection structure as claimed in claim 2, wherein the second deformed part is configured by a plurality of edgeless deformed parts of lines arranged parallel to an axis of the ring-shaped swaging member, and in a radial direction of the ring-shaped swaging member.

4. The swaging connection structure as claimed in claim 3, wherein the first deformed part is located where more tension is placed in the tubular metal foil member than the second deformed part.

5. The swaging connection structure as claimed in claim 4, wherein the tubular metal foil member is made of a metal foil or multi-layer including the metal foil.

6. The swaging connection structure as claimed in claim 3, wherein the tubular metal foil member is made of a metal foil or multi-layer including the metal foil.

7. The swaging connection structure as claimed in claim 2, wherein the second deformed part is configured by a plurality of edgeless deformed parts arranged at intervals in a radial direction of the ring-shaped swaging member.

8. The swaging connection structure as claimed in claim 7, wherein the first deformed part is located where more tension is placed in the tubular metal foil member than the second deformed part.

9. The swaging connection structure as claimed in claim 8, wherein the tubular metal foil member is made of a metal foil or multi-layer including the metal foil.

10. The swaging connection structure as claimed in claim 7, wherein the tubular metal foil member is made of a metal foil or multi-layer including the metal foil.

11. The swaging connection structure as claimed in claim 2, wherein the first deformed part is located where more tension is placed in the tubular metal foil member than the second deformed part.

12. The swaging connection structure as claimed in claim 11, wherein the tubular metal foil member is made of a metal foil or multi-layer including the metal foil.

13. The swaging connection structure as claimed in claim 11, wherein both side edges of the ring-shaped swaging member are crushed.

14. The swaging connection structure as claimed in claim 2, wherein the tubular metal foil member is made of a metal foil or multi-layer including the metal foil.

15. The swaging connection structure as claimed in claim 1, wherein the first deformed part is located at a side where the electric wire is drawn out from the swaging connection structure, and where more tension is placed in the tubular metal foil member than the second deformed part.

16. The swaging connection structure as claimed in claim 15, wherein the tubular metal foil member is made of a metal foil or multi-layer including the metal foil.

17. The swaging connection structure as claimed in claim 1, wherein the tubular metal foil member is made of a metal foil or multi-layer including the metal foil.

18. The swaging connection structure as claimed in claim 1, wherein the ring-shaped swaging member is made of a strip-shaped metal thin plate.

19. The swaging connection structure as claimed in claim 1, wherein the first deformed part is formed at a central area except a circumferential edge part of the ring-shaped swaging member in an axial direction.

20. The swaging connection structure as claimed in claim 1, wherein the second deformed part is formed in an area where the first deformed part is formed.

* * * * *